US011436953B1

(12) United States Patent
Jones

(10) Patent No.: US 11,436,953 B1
(45) Date of Patent: Sep. 6, 2022

(54) BANNER HOUSING ASSEMBLY

(71) Applicant: David Richard Jones, Arlington, TX (US)

(72) Inventor: David Richard Jones, Arlington, TX (US)

( * ) Notice: Subject to any disclaimer, the term of this patent is extended or adjusted under 35 U.S.C. 154(b) by 0 days.

(21) Appl. No.: 17/513,802

(22) Filed: Oct. 28, 2021

Related U.S. Application Data

(63) Continuation of application No. 16/672,656, filed on Nov. 4, 2019, now abandoned.

(60) Provisional application No. 62/755,231, filed on Nov. 2, 2018.

(51) Int. Cl.
*G09F 15/00* (2006.01)
*G09F 17/00* (2006.01)

(52) U.S. Cl.
CPC ..... *G09F 15/0012* (2013.01); *G09F 15/0031* (2013.01); *G09F 17/00* (2013.01); *G09F 2015/0093* (2013.01)

(58) Field of Classification Search
CPC .... A47G 1/06; A47G 1/0616; G09F 15/0025; G09F 15/0068; G09F 1/06; G09F 15/00; G09F 15/0012; G09F 15/0031; G09F 17/00; G09F 2015/0093
See application file for complete search history.

(56) References Cited

U.S. PATENT DOCUMENTS

| | | | | |
|---|---|---|---|---|
| 6,530,167 | B1 * | 3/2003 | Schuetz | A47F 7/14 40/611.01 |
| 6,594,934 | B1 * | 7/2003 | Wong | A47G 1/14 40/738 |
| 7,484,325 | B2 * | 2/2009 | Benedict | G09F 15/0025 40/606.12 |
| D716,380 | S * | 10/2014 | Burkhart | D20/43 |
| 10,477,987 | B2 * | 11/2019 | White | G09F 3/203 |

* cited by examiner

*Primary Examiner* — Cassandra Davis
(74) *Attorney, Agent, or Firm* — Jeffrey Roddy

(57) ABSTRACT

A marquee banner assembly includes one or more lightweight molding(s) that may be bowed under tension, at least one or more channels configured for the insertion of a flexible sign, and attachment brackets attachable to a substrate which may any vertical surface. The attachment brackets are angled to provide a curvature to the molding when the molding is attached to the brackets. The assembly may employ natural light alone, or any combination of natural light, artificial light.

2 Claims, 9 Drawing Sheets

3a 104
112

110
104
112
110 f

BANNER HOUSING ASSEMBLY

CROSS-REFERENCE TO RELATED APPLICATIONS

This Non-Provisional Patent application claims benefit under 35 U.S.C. 119(e) to U.S. Provisional Application No. 62/755,231 having a filing date of Nov. 2, 2018 and entitled "BANNER HOUSING ASSEMBLY" which is incorporated by reference herein in its entirety.

FIELD OF THE INVENTION

The present invention relates generally to advertising, promotional material and signage.

BACKGROUND OF THE INVENTION

Municipal restrictions of the types and sizes of advertising signage affects retail stores of all kinds. Recently, there has been a trend in commercial sign ordinances that severely restrict the location, placement and size of signs and banners. Accordingly, retailers face difficulties in adequately promoting their goods and services as well as differentiating their goods and services from competitors.

What is needed is a banner assembly that is both attention getting and sized to comply with restrictive sign ordinances.

It would be additionally desirable if such a banner were configured for display in a highly trafficked area such as an entrance to a store.

It would be desirable for such a banner assembly to be installable within minutes with only basic tools.

It would be further desirable if such a banner assembly provided various options for using natural or artificial lighting means.

The present invention eliminates the shortcomings of past art by providing a versatile system that will meet the needs of retailers struggling to promote their goods and services with a low footprint-high impact marquee-type banner assembly.

SUMMARY OF THE INVENTION

In a general example implementation according to the present disclosure, a banner assembly includes a flexible molding adapted to house an advertising banner. The banner assembly includes at least two brackets that may be attached to a substrate. The flexible molding has a front face including a least one channel adapted to receive an insertable banner, and upper and lower retention flanges. The molding has a back face attachable to the at least two brackets which are affixed to a substrate. The substrate may be part of a storefront, typically above an entrance, or, the substrate may be a separate element attachable above an entrance of a storefront. Although various implementations described herein are shown attached above an entrance of a storefront, the invention is not limited by placement or location.

In an aspect combinable with the example implementation, a distance between the attachment brackets when affixed to the substrate is less than the length of the molding in its non-biased state prior to affixment to the brackets.

In an aspect combinable with any of the previous aspects, ends of the flexible molding are affixed to the brackets in such a way as to bow the molding forming a bowed disposition.

In an aspect combinable with any of the previous aspects, plural moldings may be stacked one atop another.

In an aspect combinable with any of the previous aspects, LEDs may be placed between a translucent banner insert and a back face of the flexible molding to back light the banner.

In an aspect combinable with any of the previous aspects, LEDs may be placed along a lower and an upper lip of the flexible molding to light the banner insert from the front.

In an aspect combinable with any of the previous aspects, the molding may be a vinyl extrusion.

In an aspect combinable with any of the previous aspects, the molding may include one or more supports for an insertable banner.

In an aspect combinable with any of the previous aspects, the banner assembly may include one or more hingeable end caps to aid in the retention of the insertable banner.

Components of the present invention are light and compact enough so that an installer can easily ascend a ladder and install the assembly at an elevated height.

DETAILED DESCRIPTION OF THE INVENTION

Reference Listing of Elements

Figure 1:
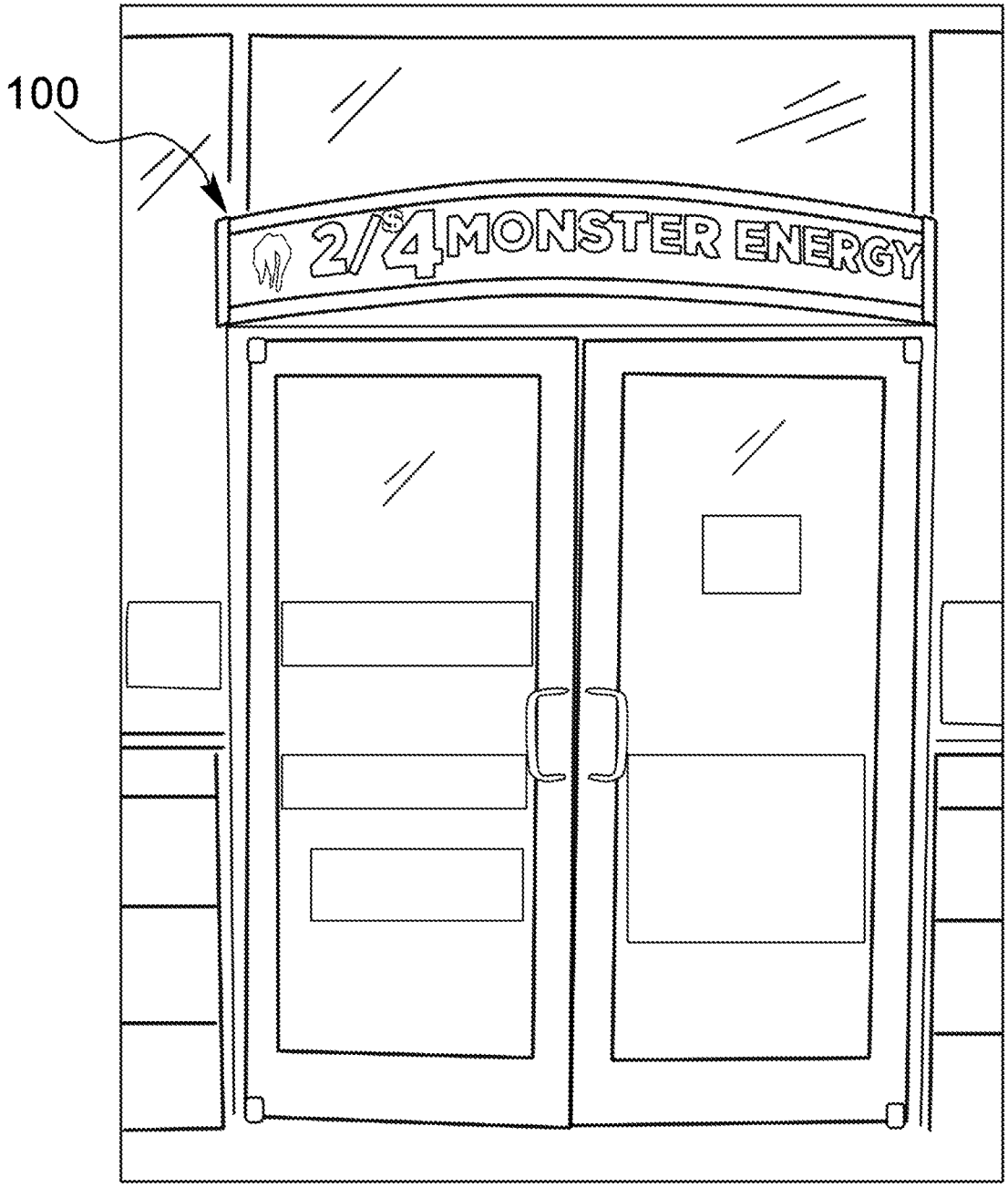
FIGS. 1 and 2 shows an installation in an typical use environment according to various implementations of the present invention.

100 banner assembly
102 banner insert
104 molding
105 channel
106 support
108 overhang

110 bracket
112 substrate
114 fastener
116 end cap
118 light strip
119 translucent panel
120 LED
122 adapter
124 reinforcing bracket Definitions The word "banner" or "banner insert" refers to any signage, typically printed on a thin plastic substrate, that may be inserted into the present invention. The terms "molding" or "flexible molding" may be used interchangeably. The term "non-biased" refers to the natural (relatively flat) state of the flexible molding prior to attachment to the brackets. In the following description, unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. It should be understood that the objects, features and aspects of any embodiment disclosed herein may be combined with any object, feature or aspect of any other embodiment without departing from the scope of the invention. The term "comprises" means "includes." All publications, patent applications, patents, and other references mentioned herein are incorporated by reference in their entirety for all purposes. In case of conflict, the present specification, including explanations of terms, will control. In addition, the materials, methods, and examples are illustrative only and not intended to be limiting.

Referring generally to FIGS. 1-14, a banner display assembly (100) includes at least one section of generally non-biased lightweight flexible molding (104), the molding includes a length, a width, a front face, a back face, opposite ends, banner supports, and at least one lengthwise channel (105) configured to slidably receive a banner insert (102) along a length of the molding. The display assembly includes molding attachment members which may be brackets (110) attachable first to a substrate (112) and then to a back side of the molding section (104). When installed according to various implementations herein, distance between the brackets is less than the length of the molding causing the molding to curve. Various implementations of the banner display assembly may be installed above an entrance to a store, a clinic, or other establishment.

Figure 2:
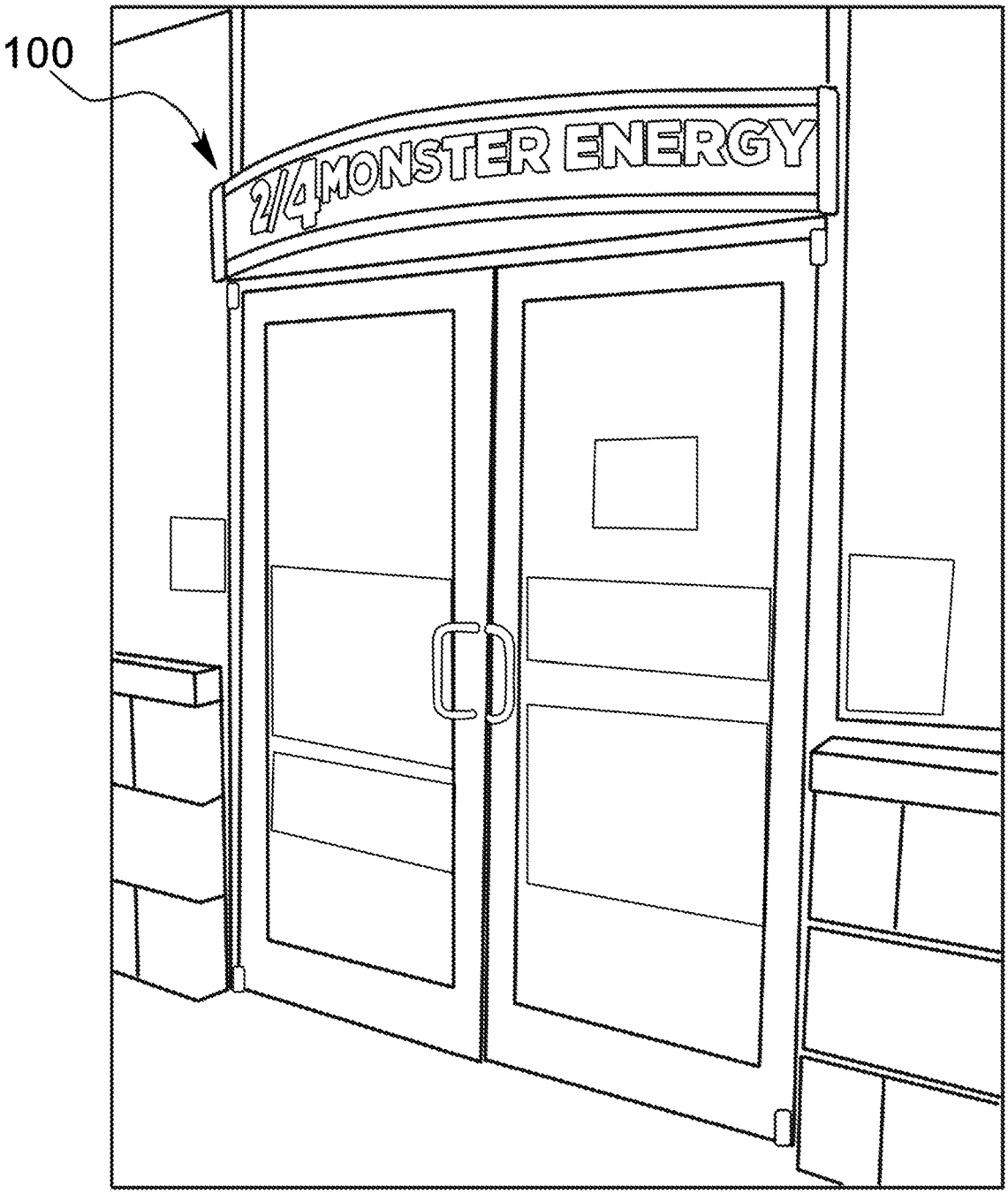

FIGS. 1 and 2 are perspective views showing a typical installation of an example implementation of the banner display assembly over an entrance to a retail store. Typically, the marquee-type assembly is approximately 6-7 feet in length, 8 to 12 inches in width, and may project 6 to 10 inches outwardly depending on the particular entrance. The flexible molding shown is extruded PVC, but any suitably resilient molding with durable weathering properties may be used. Measurements and dimensions when given, are understood to be merely exemplary and the actual dimensions may of course vary depending on the particular installation. Generally, attachment brackets (110) are affixed to a lightweight substrate (112) which is then affixed to a vertical surface, typically sections of a storefront above a entrance. Ends of the flexible molding (104) may then be attached to the brackets (110) by any appropriate fastening means such as threaded fasteners, bolts, rivets, studs, etc. In any case, the brackets are disposed such that when the ends of the flexible molding are affixed, the molding is caused to bow outwardly over the entrance. Typically opposite ends of the molding are open so that a banner may be readily inserted or removed from either end. Additionally, in some implementations, the ends of the molding may be beveled to provide easier access to an inserted banner. Although the curvature alone of the molding may be sufficient to retain and protect an inserted banner within channel (105) from environmental factors such as wind, hingeable end caps (116) may be attached by any suitable fastener at ends of the molding. When installing a banner, an end cap (116) at the leading edge of the banner is pivoted to expose the opening of channel (105). Once the banner is installed, the end cap is snapped shut.

Figures 3, 3A, 3B:
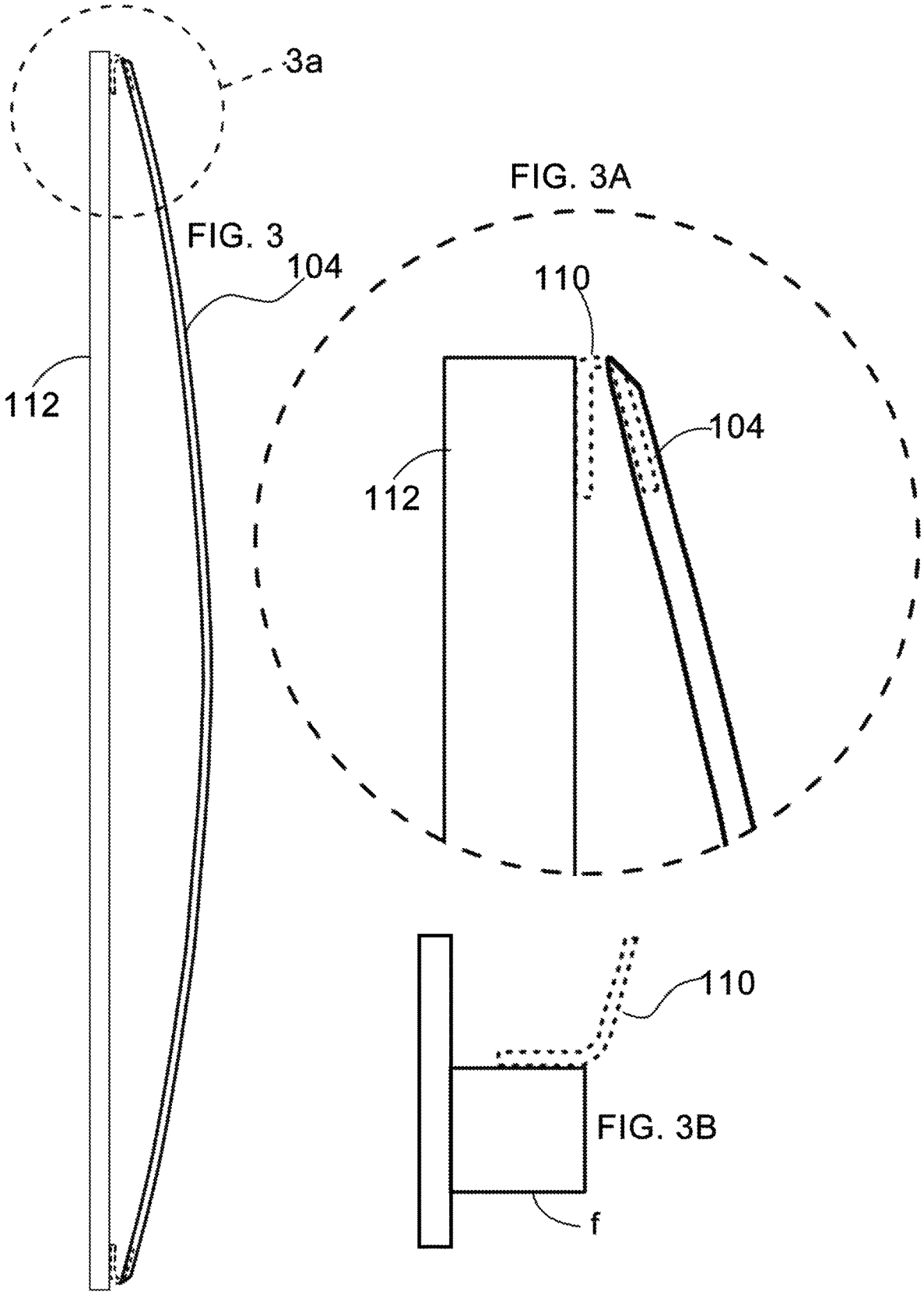
FIG. 3 shows a top view of an exemplary implementation according to the present invention.
FIG. 3A is an enlarged detail view thereof showing bracket 110 attached to a substrate (112)
FIG. 3B is another implementation showing an alternate installation of a bracket to a window frame (f)

FIG. 3 and enlarged detail 3A show a typical installation that includes a substrate which may be part of a storefront such as a window above double doors, or a lightweight board that affixed to a storefront. Brackets (110) shown in dashed line, are attached to the substrate, typically by threaded fasteners. Flexible molding (104), typically a straight length of extruded PVC, is affixed at its ends to the brackets 110 by any suitable fastening means such as push-in rivets causing the molding to curve. Typically, brackets (110) may have an angle between 10 and 50 degrees. While in the implementation shown, the top flange of bracket (110) is shown inserted into the channel, it is possible that the top flange be positioned behind the channel for attachment to the molding. It is also conceivable that a bracket having an angle greater than 50 degrees may be affixed to the side of a window frame as shown in (FIG. 3B) in order to obtain the same amount of curvature as with other described methods.

Figure 4:
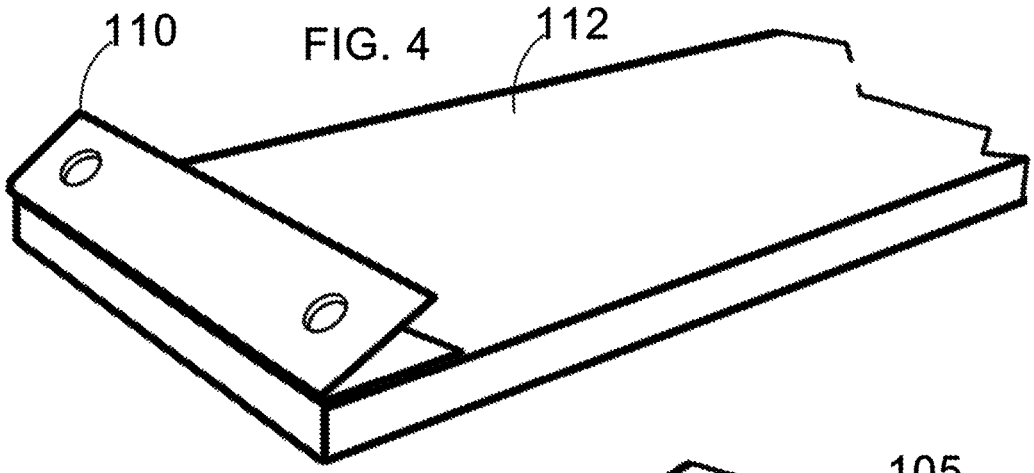
FIG. 4 shows an initial step in installation according to various implementations of the invention with the attachment of bracket (110) to substrate (112)
Figure 5:
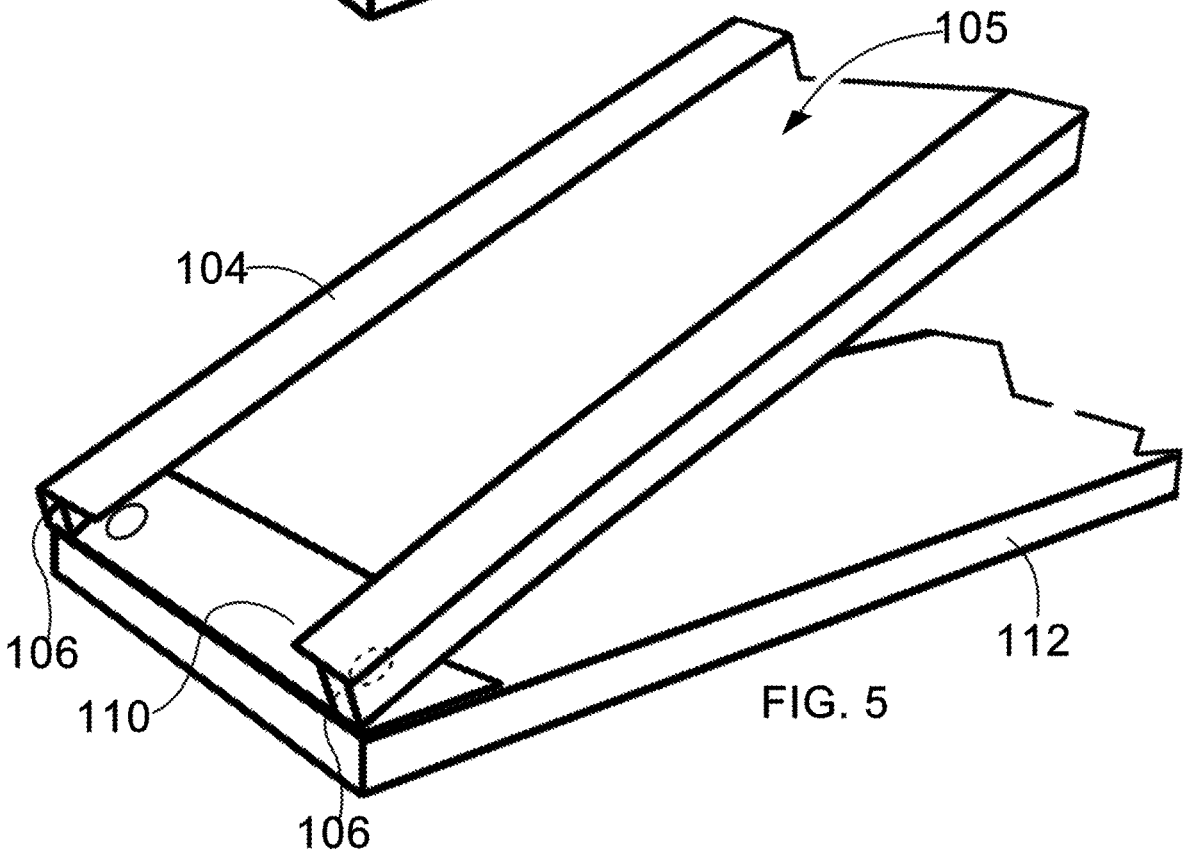
FIG. 5 shows a second step in installation according to various implementations of the invention with the attachment of molding (104) to brackets(s) (110)

FIGS. 4 and 5 are partial perspective views showing a left side of a basic installation wherein bracket(s) (110) are attached to substrate (112), and then flexible molding (104) is attached to the brackets. It should be noted that channel (105) is bordered longitudinally by support elements (106) that may be longitudinal channels beneath overhang (108). An inserted bracket (110) is generally sized so the width thereof matches the transverse distance between support elements. When the brackets are properly installed on the substrate and the channel is fitted below the top flange, the top flange nests tightly between the support elements, and the molding self aligns.

Figures 6A, 6B:
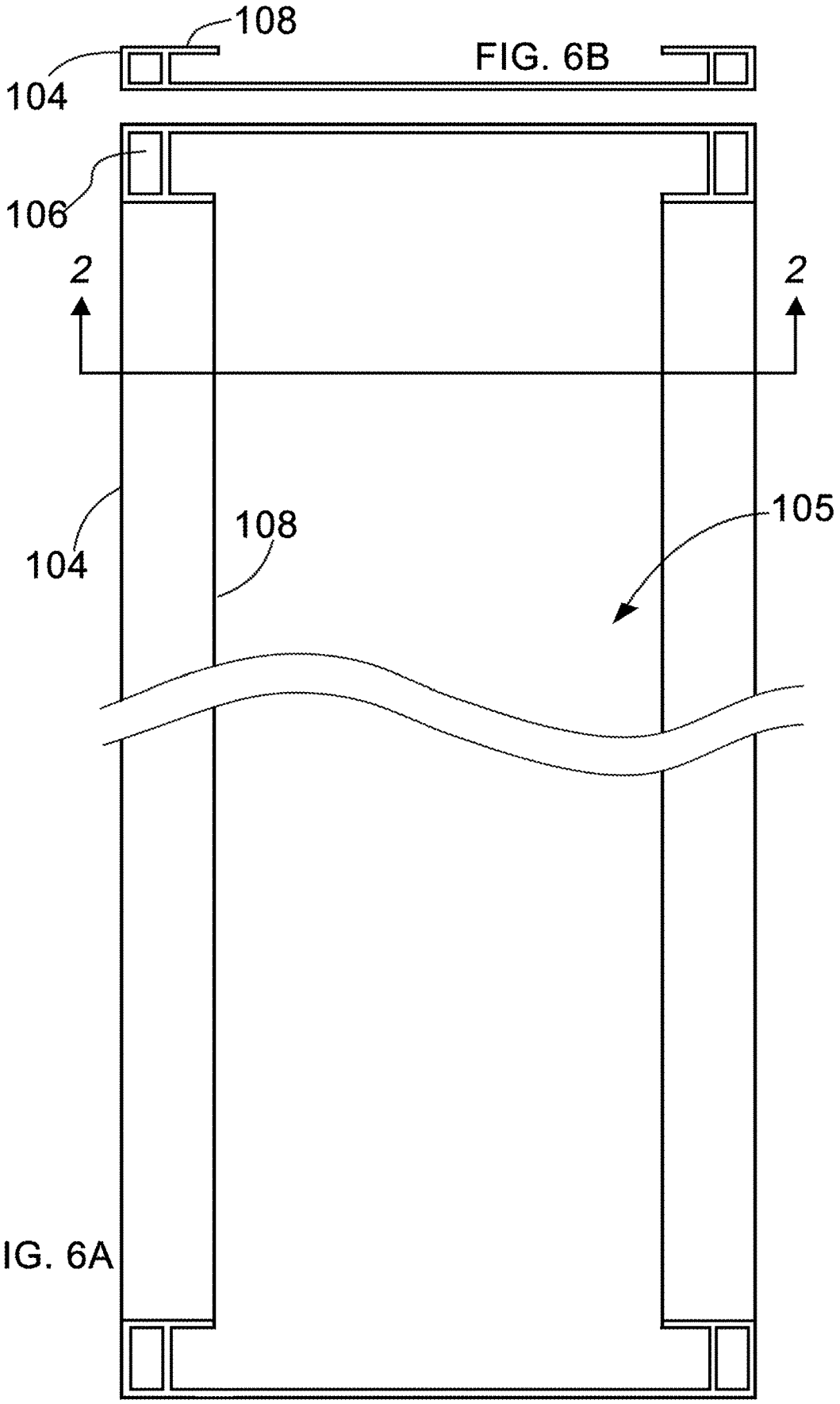
FIG. 6A is a side elevation of a portion of a banner assembly according to various implementations of the invention wherein the ends are bevel cut or slanted.
FIG. 6B is a sectional view taken along lines 2-2 of (FIG. 6A)

FIG. 6A is a side elevation showing a front face of a section of flexible molding. FIG. 6B is a cross-sectional view thereof taken along lines 2-2. Support elements (106) center and retain an inserted banner. Ends of the flexible molding may be 90 degrees or beveled as depicted.

Figure 7:
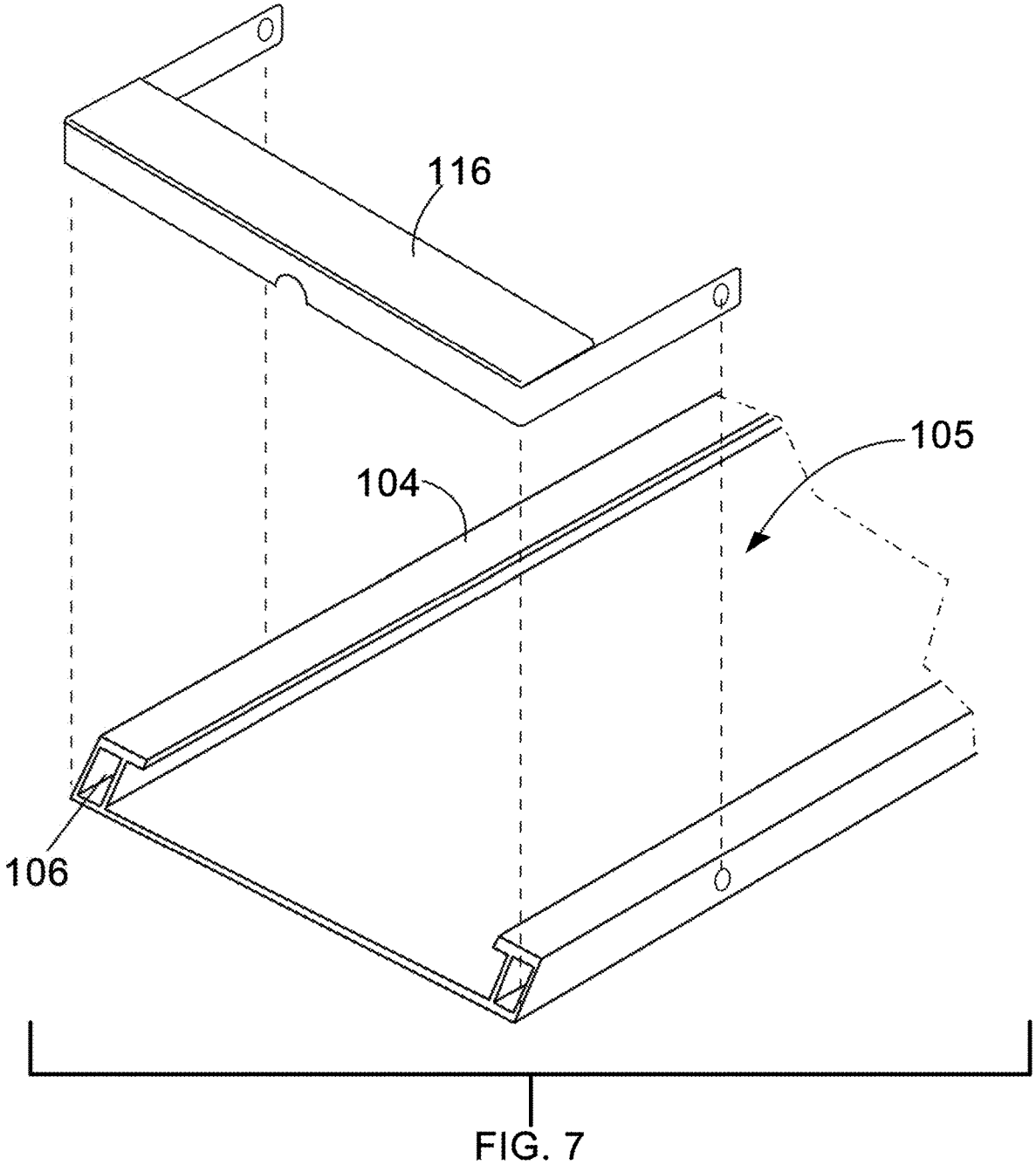
FIG. 7 is a partial exploded view of portions of a banner assembly according to various implementations of the invention.

FIG. 7 is a partial exploded view of an example implementation showing an end of the flexible molding (104) and a hingeable end cap (116).

Figure 8:
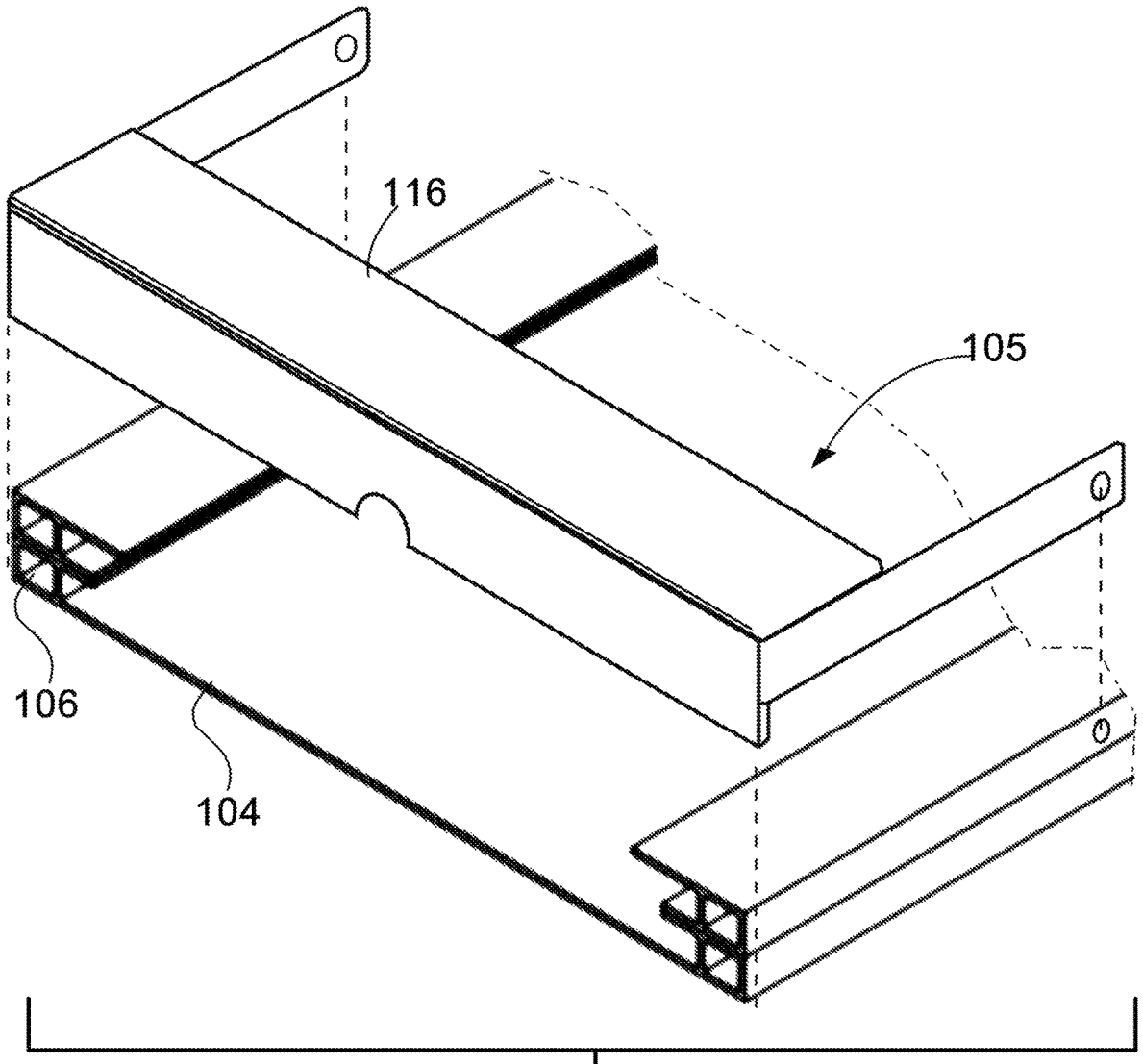
FIG. 8 is another partial exploded view of portions of a banner assembly according to various implementations of the invention.
Figure 9:
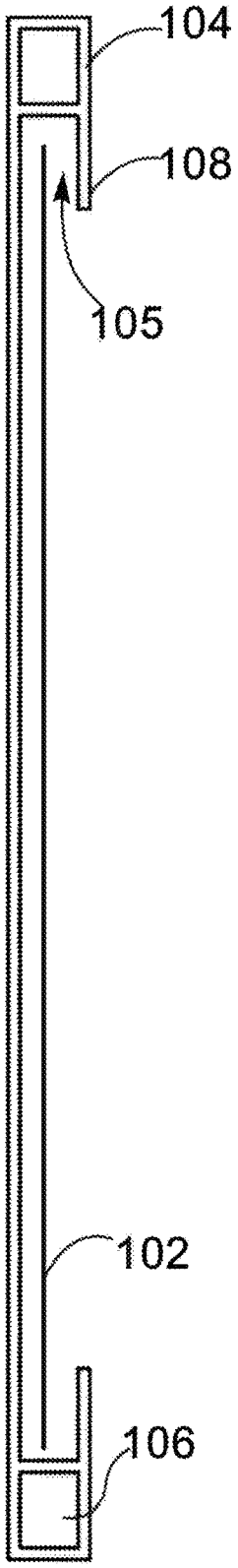
FIG. 9 is a side view of a molding portion in a first example implementation of a banner assembly.
Figure 10:
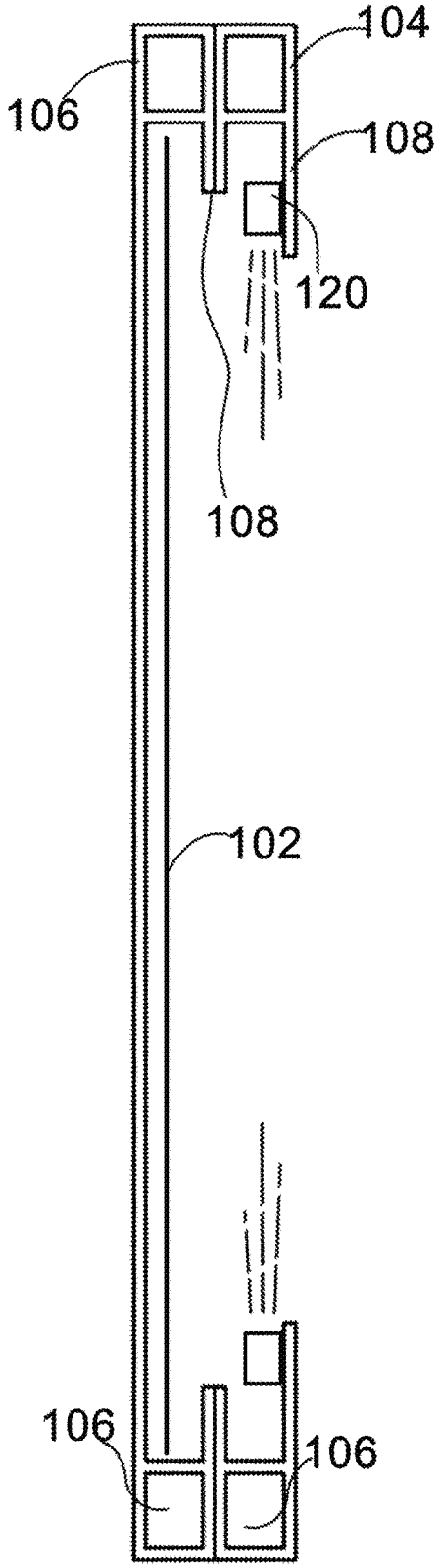
FIG. 10 is a side view of a molding portion in a second example implementation of a banner assembly.
Figure 11:
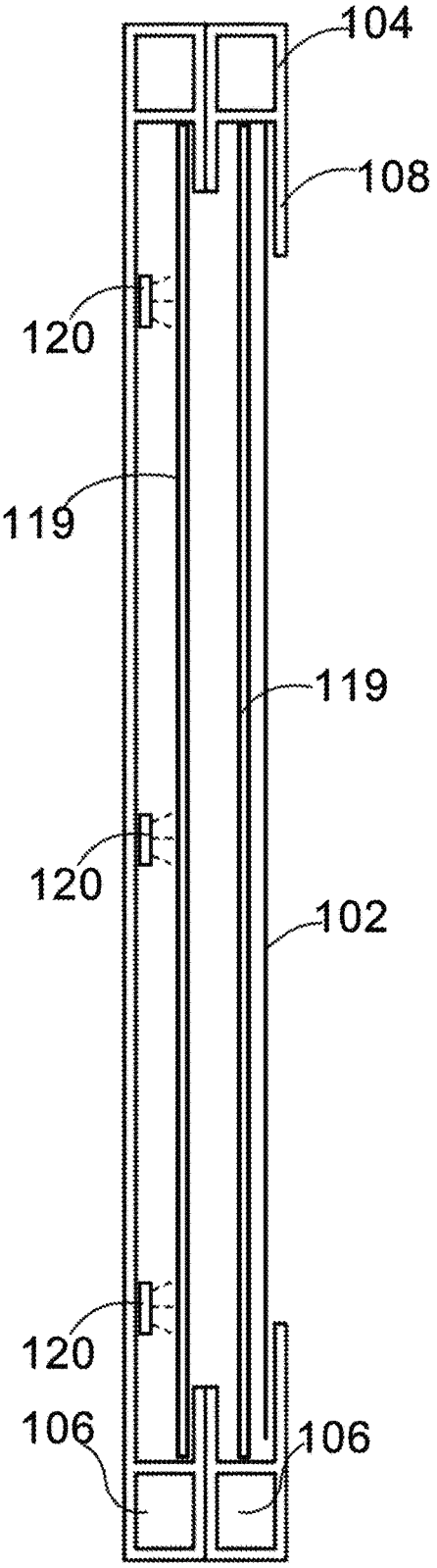
FIG. 11 is a side view of a molding portion in a third example implementation of a banner assembly.
Figure 12:
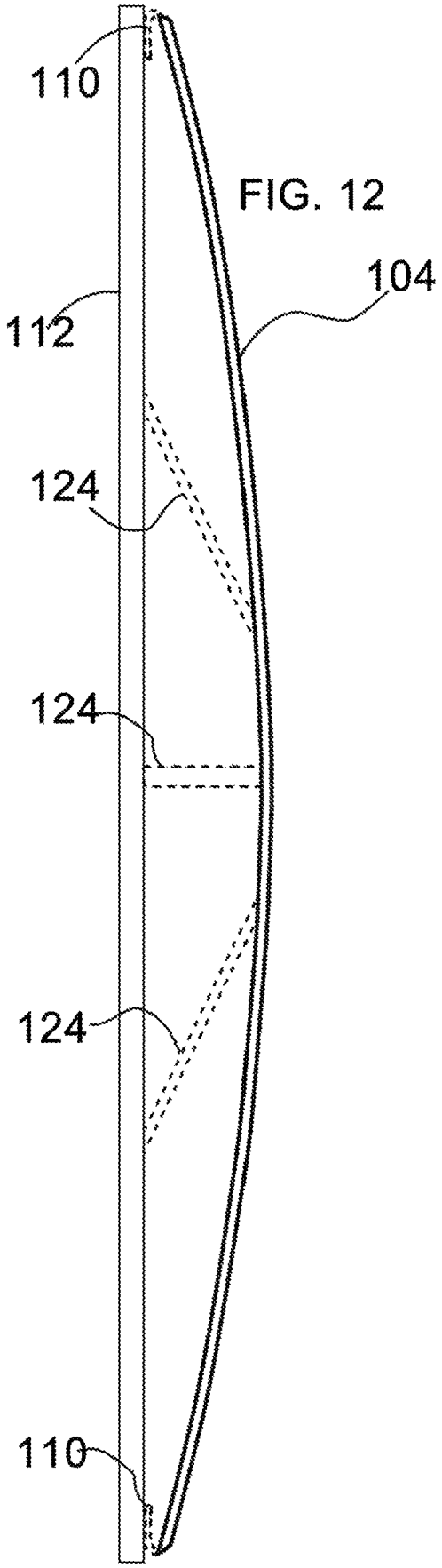
FIG. 12 is a top view showing an implementation that includes reinforcing or bracing the molding (104) to span relatively wider entrances.

FIG. 8 is another partial exploded view of an example implementation with stacked moldings showing one end of the moldings (104) and a hingeable end cap (116). Stacked moldings may be used in cases where a lighted display is desired and the additional channels accommodate LED strips or other lighting means. Various implementations described herein show both unlighted, back lighted and front lighted displays. FIG. 9 is a side elevation showing one end of a molding in its non-biased state; e.g., prior to attachment to brackets (110), that includes a single molding (104) and banner (102) placement. FIG. 10 is a side elevation showing an end of an implementation in its non-biased state that includes pair of stacked moldings wherein the banner is lighted from the front; typically by upper and lower LED cable strip lighting or LED tape lights such as RibbonFlex Pro by Armacost Lighting, or light strips by Grote Industries. In any case, such LED lighting may be easily powered via an appropriate plug in adapter (not shown). FIG. 11 shows an implementation in its non-biased state with a pair of stacked moldings wherein the banner is back lit. Banner inserts are typically printed on a thin flexible plastic substrate which may be polycarbonate film, polyester film, and rigid polycarbonate that may be opaque or translucent as required. It should be noted that when the moldings are stacked, the base molding includes the central channel, while the top molding lacks the central channel. However, in the implementation described, a molding can be cut longitudinally and the central channel thereby removed. The pair of side channels can then be affixed atop the base molding as shown. In the backlit example, LEDs are placed on a surface the base molding channel, followed by a first translucent panel (119) that may be frosted to diffuse the LED lighting. A second translucent panel (119) may be placed as shown behind the banner insert (102). It should be understood that spacers, such as foam inserted may be placed between the lips/overhang (108) of the molding to separate the translucent panels from the LEDs or to simply retain any of the inserted elements, e.g., banner insert, translucent panels fixed positions.

It should be noted that while implementations according to the present invention are sized to fit a standard manual door, e.g., approximately 72 inches in width, the molding may be sized to fit wider automatic doors.

It should be understood that the drawings and detailed description herein are to be regarded in an illustrative rather than a restrictive manner, and are not intended to be limiting to the particular implementations, forms and examples disclosed. Accordingly, it is intended that this disclosure encompass any further modifications, changes, rearrangements, substitutions, alternatives, design choices, and implementations as would be appreciated by those of ordinary skill in the art having benefit of this disclosure, and falling within the spirit and scope of the following claims.

What is claimed is:

1. A marquee-type display comprising:

at least one section of lightweight flexible molding capable of bending to various radii when opposite ends of the flexible molding are disposed closer or further apart, the molding includes a length, a width, opposite ends, a front side and a back side, and first channel adapted to receive a flexible sign including an upper lip and a lower lip, a pair of second enclosed channels forming supports along the length of the molding, and a backing panel bridging a space between the upper and lower lips of the first channel, and, at least one pivotable end cap attached to one of the opposite ends;

at least two brackets with an angle range attaching the opposite ends to a substrate.

2. The marquee-type display according to claim 1, wherein the at least two brackets further includes an angular range of between 10 and 50 degrees.

* * * * *